United States Patent [19]

Nakagawa

[11] Patent Number: 4,679,392

[45] Date of Patent: Jul. 14, 1987

[54] PROCESS FOR PRODUCING A GARLAND CHAIN

[75] Inventor: Shigesaburo Nakagawa, Ichikawa, Japan

[73] Assignee: Nakagawa Corporation, Tokyo, Japan

[21] Appl. No.: 873,917

[22] Filed: Jun. 13, 1986

Related U.S. Application Data

[63] Continuation-in-part of Ser. No. 774,844, Sep. 11, 1985, abandoned.

[30] Foreign Application Priority Data

Jul. 1, 1985 [JP] Japan ..... 60-144146

[51] Int. Cl.[4] ..... B21L 11/00

[52] U.S. Cl. ..... 59/35.1; 59/27; 59/80; 63/4; D11/13

[58] Field of Search ..... 59/30, 27, 28, 29, 35.1, 59/78, 83, 84, 92, 93; 63/4; D11/12, 13

[56] References Cited

U.S. PATENT DOCUMENTS

| | | | |
|---|---|---|---|
| 1,372,693 | 3/1921 | Hodges | 59/83 |
| 1,810,060 | 6/1931 | Selle | 59/80 |
| 2,069,980 | 2/1937 | Stahl | 59/35.1 |
| 2,184,127 | 12/1939 | Reyburn | 59/35.1 |
| 2,196,686 | 4/1940 | Stahl | 59/35.1 |
| 3,342,029 | 9/1967 | Campbell, Jr. | 59/28 |
| 3,715,884 | 2/1973 | Sanders | 59/78 |
| 3,733,852 | 5/1973 | Johnson et al. | 63/2 |

OTHER PUBLICATIONS

A History of Jewelry by J. Anderson Black. 3 pages including Figures labelled FIG. 1, FIG. 2 and FIG. 3.

Jewelry Concepts and Technology, Oppi Untracht, Double Day & Co. 1982, pp. 184–196.

Gold Jewellery Japan, International Gold Corp. of Japan Ltd. 1984.

*Primary Examiner*—Robert L. Spruill

*Assistant Examiner*—David B. Jones

*Attorney, Agent, or Firm*—Armstrong, Nikaido, Marmelstein & Kubovcik

[57] ABSTRACT

A method for forming a garland chain is disclosed, wherein an original chain formed of either long links or of long and short links is worked to produce a garland chain. The garland chain is formed by sliding one link on another so that two attached links are positioned at one end of a long link, and deforming the long link to constrict the central or medial portion, thereby retaining the two attached links at the same end of the long link. Deformation may be applied in the form of crimping, bending or twisting of the links, or combinations of these methods. The deforming methods can be applied to every long link in a chain, or to selected sequences of long links, to create different garland chain effect.

14 Claims, 34 Drawing Figures

PROCESS FOR PRODUCING A GARLAND CHAIN

This application is a continuation-in-part of application Ser. No. 774,844 filed Sept. 11, 1985, now abandoned.

SUMMARY OF THE INVENTION

The invention relates to a process for producing a novel garland chain from a chain formed of a plurality of connected links, and can be applied to a chain formed entirely of long links or one formed of combinations of long and short links. For the purpose of this discription, a short link is one having a length less than twice its width, and a long link is one having a length equal to or greater than twice its width.

The process of the invention is carried out by sliding or moving a first link attached to a long link of a chain to an end of the long link so as to position it adjacent to another link at that end, and then deforming the long link to contract or constrict a medial portion so as to retain the link so moved in position next to the adjacent link and to prevent movement of both links away from that end of the long link. Different garland effects can be achieved by applying the process to every long link in a chain, or by applying it to selected sequences of one or more long links interspersed with one or more links to which the process is not applied. Also, different garland effects can be obtained by selectively using different methods for deforming the long links, such as crimping or squeezing, twisting, and bending, and by selectively moving links on different sides of the chain.

DETAILED DESCRIPTION OF PREFERRED EMBODIMENTS

FIGS. 1(*a*)–1(*f*) show a first embodiment of the present invention wherein the process is applied to a chain consisting of long links A1, A2, A3, A4 as shown in FIG. 1(*a*). In FIG. 1(*b*) the lower link A1 is deformed by crimping at its center or medial portion 1, and is then slid or moved longitudinally along link A2 until it is adjacent line A3, as shown in FIG. 1(*c*). This process is then repeated with link A2, deforming that link at its center 1 in the same manner, as shown in FIG. 1(*d*), to retain link A1 in position, and sliding link A2 on link A3 to come adjacent to link A4, as shown in FIG. 1(*e*). Link A3 is then crimped at its center 1 to retain link A2 in that position.

Figures 7A, 7C, 7E:
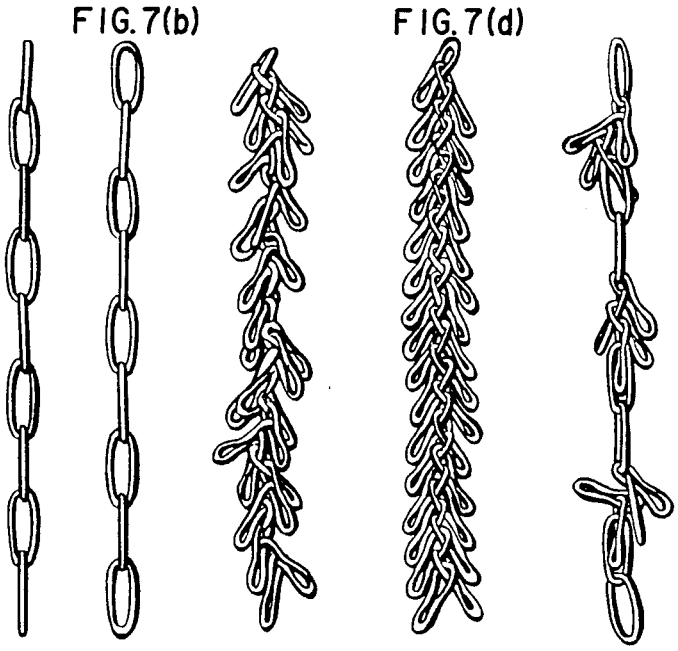
FIGS. 7(*a*)–7(*e*) show examples of garland effects achieved by the first embodiment of the process shown in FIGS. 1(*b*)–1(*f*).

Garland chains obtained by this first embodiment are shown in FIGS. 7(*a*)–7(*e*). FIGS. 7(*a*) and 7(*b*) show a front and side view, respectively, of the original chain. FIGS. 7(*c*) and 7(*d*) show garland chains produced when every link is subjected to the above described garland forming process, and FIG. 7(*e*) shows a garland chain produced when four successive links are subjected to the process and the next two successive links are skipped.

FIGS. 2(*a*)–2(*f*) show a second embodiment of the invention applied to a chain consisting of alternate long links A1, A2, A3, A4 and short links B1, B2, B3 as shown in FIG. 2(*a*). The distortion of chain links involved in the garland forming process is applied only to the long links A1, A2, A3, A4. Link A1 is crimped to deform it at its center or medial portion 1, as shown in FIG. 2(*b*), and then link B1 attached to link A1 is slid up link A2 to bring it adjacent to link B2, as shown in FIG. 2(*c*). Link A2 is also deformed at its center 1, as shown in FIG. 2(*d*), link B2 is slid up link A3 to be adjacent link B3 as shown in FIG. 2(*e*), and link A3 is crimped at its center 1 as shown in FIG. 2(*f*). This process may be carried out on every long link, or on selected sequences of long links.

Figures 8A, 8B, 8C, 8D, 8E, 8F, 8G:
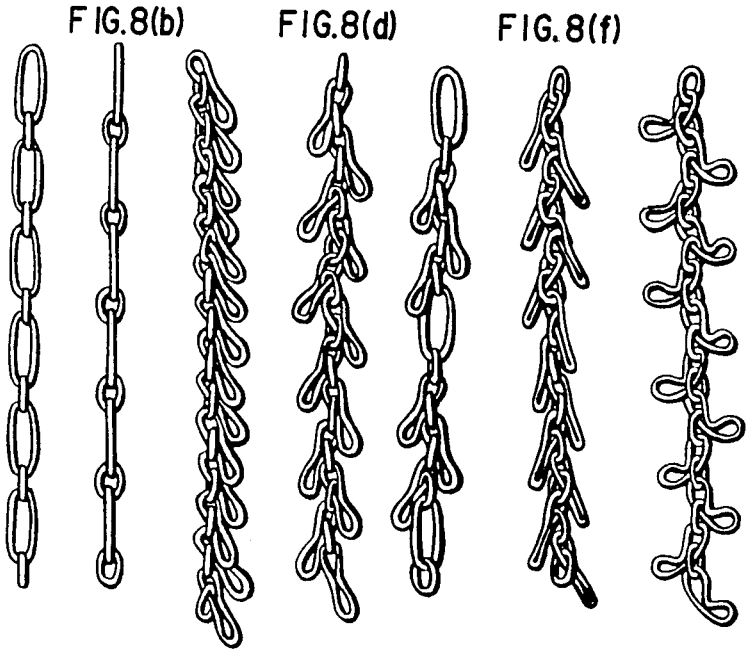
FIGS. 8(*a*) and 8(*b*) show front and side views of an original chain of the type to which the second embodiment of FIGS. 2(*a*)–2(*f*) is applied, and FIGS. 8(*c*)–8(*g*) show examples of garland effects obtained by this embodiment.

FIGS. 8(*a*) and 8(*b*) show, respectively, front and side views of the chain of the second embodiment, and FIGS. 8(*c*)–8(*g*) show several garland chain configurations obtainable. FIGS. 8(*c*), 8(*d*) and 8(*f*) show garland chains achieved by applying the process to each long link of such a chain. In FIGS. 8(*c*) and 8(*f*) the links are all moved up on the same side of the chain, and in FIG. 8(*d*) they are moved up alternately on the right side and left side. FIG. 8(*e*) shows a garland chain obtained by applying the crimping process to three successive long links and then skipping one long link. In FIG. 8(*f*) the entire lower end of each long link is crimped or squeezed together. FIG. 8(*g*) shows a garland chain produced by bending the long links at opposite sides of the chain.

Figure 1A:
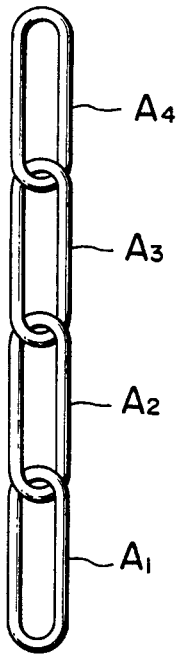
FIGS. 1(*a*)–1(*f*) show the process applied to an original chain consisting of all long links, wherein the links are deformed by crimping or squeezing at the center.
Figure 1B:
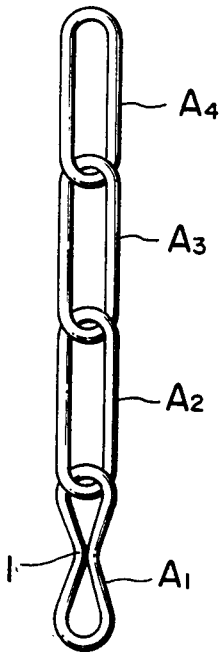
Figure 1C:
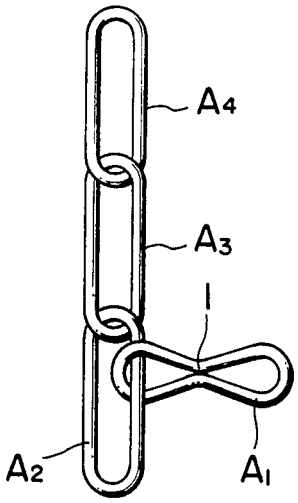
Figure 1D:
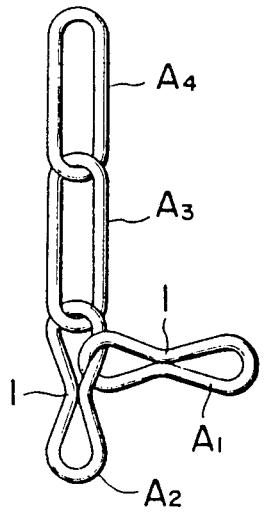
Figure 1E:
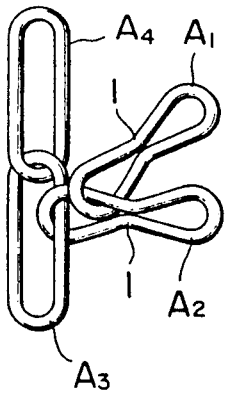
Figure 1F:
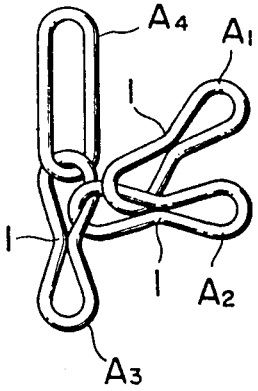
Figure 2A:
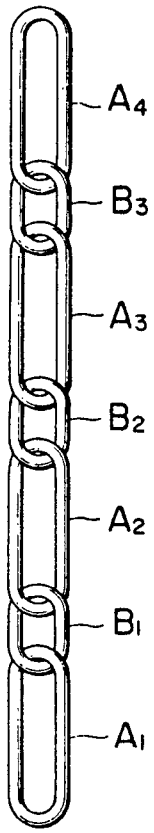
FIGS. 2(*a*)–2(*f*) show the process applied to an original chain of alternate long and short links, wherein the long links are deformed by crimping or squeezing.
Figure 2B:
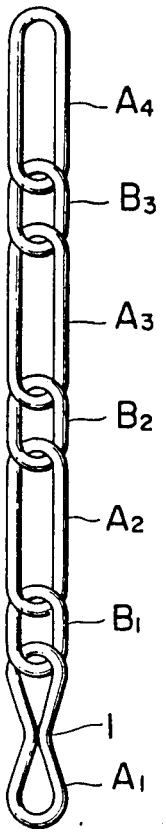
Figure 2C:
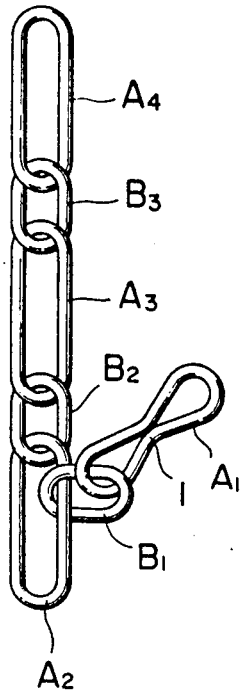
Figures 2D, 2E, 2F:
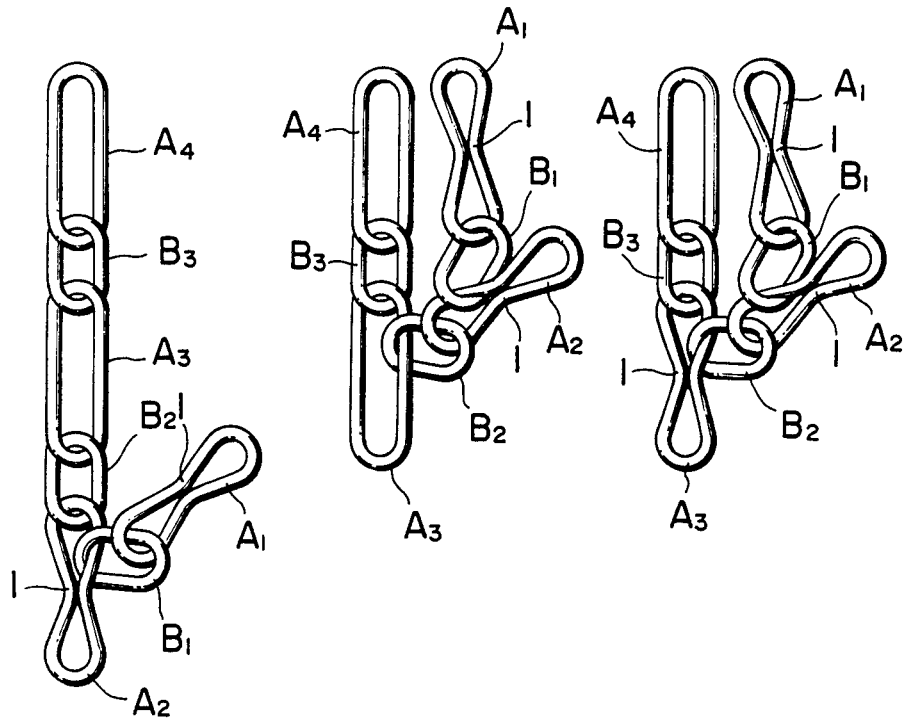
Figure 3A:
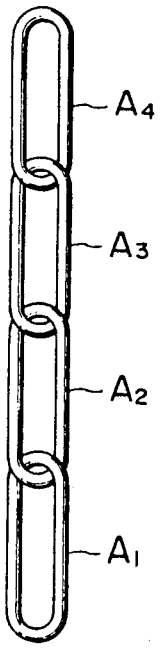
FIGS. 3(*a*)–3(*f*) show the process applied to a chain of long links wherein the links are twisted.
Figure 3B:
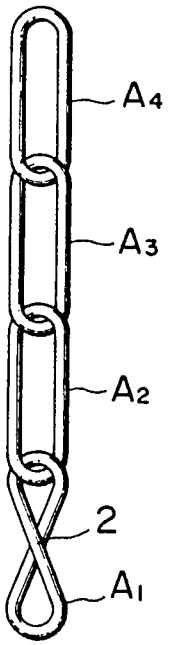
Figure 3C:
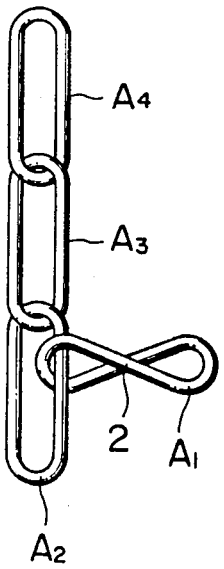
Figure 3D:
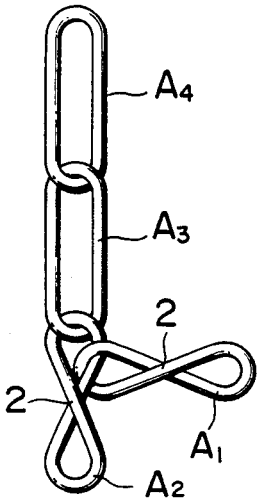
Figure 3E:
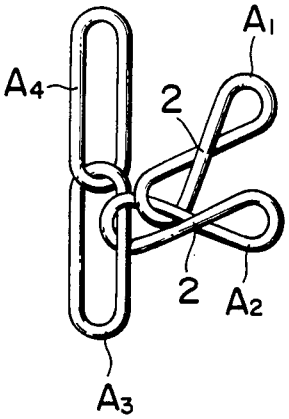
Figure 3F:
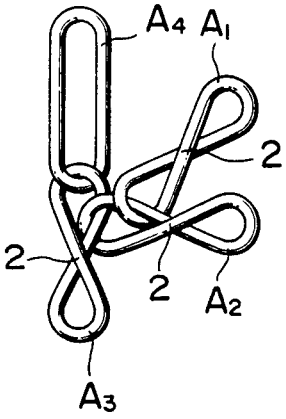
Figure 4A:
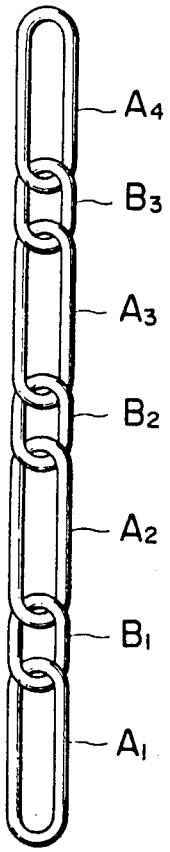
FIGS. 4(*a*)–4(*f*) show the process applied to a chain of long and short links wherein the long links are twisted.
Figure 4B:
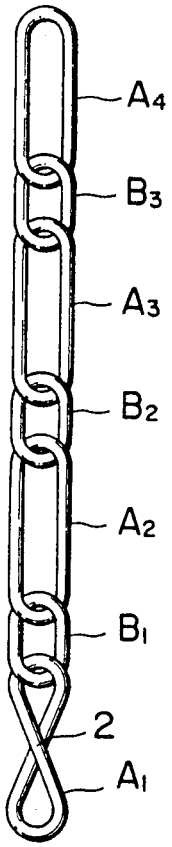
Figure 4C:
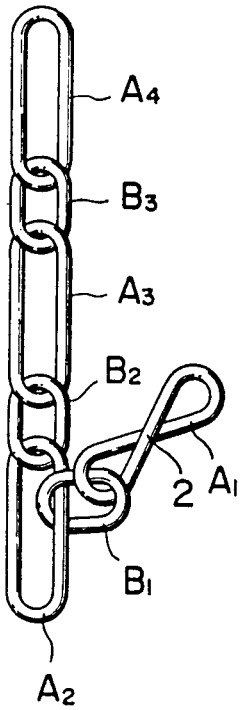
Figure 4D:
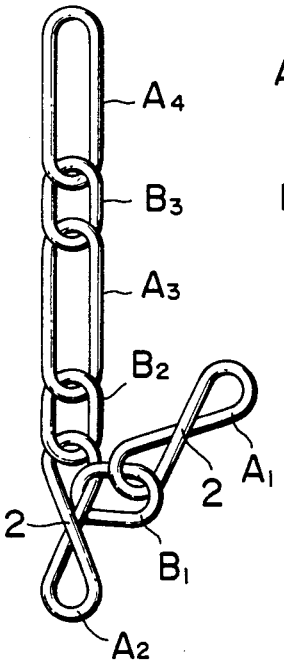
Figure 4E:
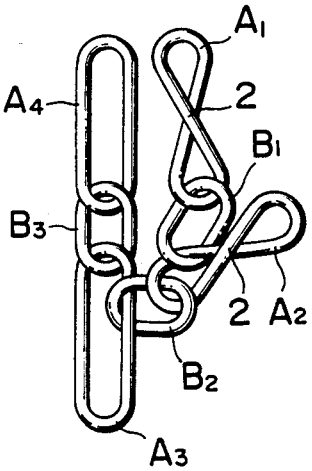
Figure 4F:
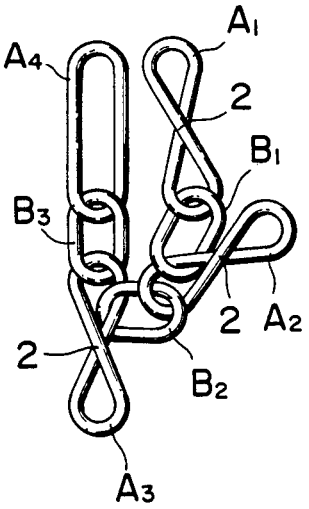
Figures 5A, 5B, 5C, 5D, 5E, 5F, 5G:
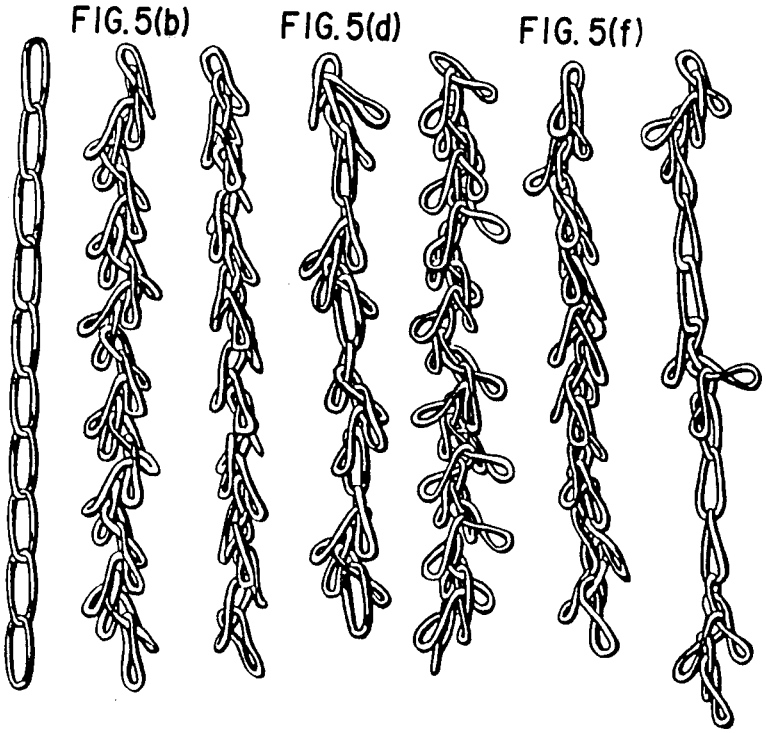
FIGS. 5(*a*)–5(*g*) show an original chain of the type shown in FIG. 3(*a*), and various garland effects achieved by application of the third embodiment as shown in FIGS. 3(*b*)–3(*f*).

FIGS. 3(*a*)–3(*f*) show a third embodiment of the invention, similar to that of FIGS. 1(*a*)–1(*f*) except that the ohain links are twisted to bring their center portions close together as shown at 2. Otherwise this process is the same as that shown in FIG. 1(*a*)–1(*f*). FIG. 5(*a*) shows a chain of this type, and FIGS. 5(*b*)–5(*g*) show garland chains produced by application of this embodiment to such a chain. FIGS. 5(*b*) and 5(*e*) show garland chains produced by sliding links up on one side of the chain, and FIGS. 5(*c*) and 5(*f*) show configurations of garland chains obtained by applying the process alternately to the right hand and left hand sides of successive links of the chain. FIG. 5(*d*) shows a garland chain obtained by applying the process to four successive links and skipping one link, and FIG. 5(*g*) shows a garland chain obtained by applying the process to four successive links and skipping the next three links.

Figure 6A:
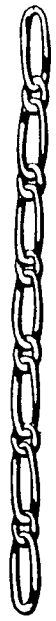
FIGS. 6(*a*)–6(*c*) show an original chain as used in FIG. 4(*a*) and examples of garland effects achieved by the fourth embodiment of FIGS. 4(*b*)–4(*f*).
Figure 6B:
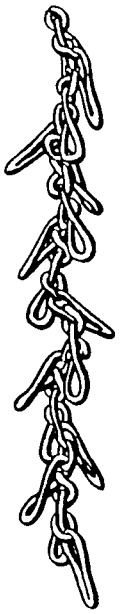
Figure 6C:
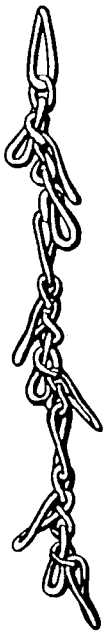

FIGS. 4(*a*)–4(*f*) show a fourth embodiment involving the application of the process of FIGS. 3(*a*)–3(*f*) to a chain as shown in FIG. 2(*a*) composed of long and short links. In this embodiment the long links are twisted, instead of crimped as in FIGS. 2(*b*)–2(*f*). FIG. 6(*a*) shows a chain of this type, while FIG. 6(*b*) shows a garland chain produced by applying the process to each one of the long links of the chain, and FIG. 6(*c*) shows a garland chain produced by applying the process to three successive long links and skipping the next long link.

It will be appreciated that the process used to constrict the medial portions of the long chain links is not limited to applying the described methods individually, but that these methods may be combined. For example, a long link may be partially twisted and then crimped, or it may be twisted and bent, or it may be crimped and bent. Furthermore, the different deforming methods may be used alternatively on different links on the same chain to produce other variations in the final product. Also, links may be additionally deformed in other wáys, not necessary to constrict the movement of links along a deformed link to which they are attached. According, the foregoing description is not to be considered as limiting the scope of the appended claims.

What I claim is:

1. A process for producing a garland chain comprising the steps of:

(a) forming a chain comprising a plurality of connected links, including a plurality of long links, said long links having a length at least twice their width;

(b) moving a first link attached to a long link of said chain to an end of said long link to be adjacent to a second link attached to said long link at said end;

(c) deforming said long link at a medial portion thereof so as to prevent movement of said first and second links away from said end of said long link; and (d) repeating said moving and deforming steps with respect to additional long links of said chain.

2. A process as recited in claim 1, wherein said chain is formed of long links only.

3. A process as recited in claim 1 wherein said chain is formed of long links and short links, said short links having a length less than twice their width.

4. A process as recited in claim 3, wherein said chain is formed of alternate long and short links.

5. A process as recited in claim 1, wherein said step of deforming is carried out by at least one of a plurality of deforming methods including crimping, squeezing, twisting, and bending.

6. A process as recited in claim 1, wherein said moving and deforming steps are performed on each long link of said chain.

7. A process as recited in claim 1, wherein said moving and deforming steps are performed on selected sequences on long links of said chain and omitted on other long links.

8. A process as recited in claim 2, wherein said moving and deforming steps are performed on each long link of said chain.

9. A process as recited in claim 3, wherein said moving and deforming steps are performed on each long link of said chain.

10. A process as recited in claim 4, wherein said moving and deforming steps are performed on each long link of said chain.

11. A process as recited in claim 2, wherein said moving and deforming steps are performed on selected sequences of long links of said chain and omitted on other long links between said sequences.

12. A process as recited in claim 4, wherein said moving and deforming steps are performed on selected sequences of long links of said chain and omitted on other long links between said sequences.

13. A process for producing a garland chain comprising the steps of:

(a) forming a chain comprising a plurality of long links, said links having a length at least twice their width and being serially connected to each other;

(b) deforming a first link of said chain at a medial portion of said link;

(c) moving the first link attached to a second link along said second link to an end thereof so as to be positioned adjacent to a third link attached to said second link at said end of said second link;

(d) deforming said second link at a medial portion to prevent movement of said first and third links away from said end of second link; and (e) repeating said moving step and subsequent deforming step with respect to selected additional links along a length of said chain.

14. A process for producing a garland chain comprising the steps of:

(a) forming a chain comprising long links having a length at least twice their width and short links having a length less than twice their width, said long and short links being connected together alternately;

(b) deforming a first long link of said chain at a medial portion of said link;

(c) moving a first short link attached to said first long link and to a second long link along said second long link to an end of said second long link to position said first short link adjacent to a second short link attached to said end of said second long link;

(d) deforming said second long link at a medial portion so as to retain said first and second short links at said end of said long link; and (e) repeating said moving step and subsequent deforming step with respect to selected additional short and long links, respectively, along a length of said chain.

* * * * *